US012757964B2

(12) United States Patent
Muskovitz

(10) Patent No.: US 12,757,964 B2
(45) Date of Patent: Oct. 13, 2026

(54) ADJUSTABLE FIT SYSTEMS FOR USE WITH PROTECTIVE HELMETS AND HELMET AND ADJUSTABLE FIT ASSEMBLIES

(71) Applicant: RESOLUTION STRATEGIC DEVELOPMENT, INC., Park City, UT (US)

(72) Inventor: David T. Muskovitz, Park City, UT (US)

(73) Assignee: RESOLUTION STRATEGIC DEVELOPMENT, INC., Park City, UT (US)

( * ) Notice: Subject to any disclaimer, the term of this patent is extended or adjusted under 35 U.S.C. 154(b) by 0 days.

(21) Appl. No.: 18/814,315

(22) Filed: Aug. 23, 2024

(65) Prior Publication Data

US 2025/0064164 A1 Feb. 27, 2025

Related U.S. Application Data

(60) Provisional application No. 63/621,452, filed on Jan. 16, 2024, provisional application No. 63/534,312, filed on Aug. 23, 2023.

(51) Int. Cl.
*A42B 3/32* (2006.01)
*A42B 3/08* (2006.01)

(52) U.S. Cl.
CPC ..... *A42B 3/324* (2013.01); *A42B 3/08* (2013.01)

(58) Field of Classification Search
CPC ..... A42B 3/324; A42B 3/08; A42B 3/145
(Continued)

(56) References Cited

U.S. PATENT DOCUMENTS 3,028,602 A 4/1962 Miller
3,354,468 A * 11/1967 Bowers, Jr. ..... A42B 3/142 2/421

(Continued)

FOREIGN PATENT DOCUMENTS

CH 657024 A5 8/1986
DE 102011012972 A1 11/2012

(Continued)

OTHER PUBLICATIONS

International Preliminary Report on Patentability received for PCT Patent Application No. PCT/US2023/072874, mailed on Mar. 6, 2025, 9 pages.

(Continued)

*Primary Examiner* — Timothy K Trieu
(74) *Attorney, Agent, or Firm* — Workman Nydegger

(57) ABSTRACT

A helmet and adjustable fit assembly include an adjustable fit system attachable to a helmet shell configured to at least partially cover a wearer's head. The helmet shell includes outer and inner components, a front, back, left side region, and right side region. The adjustable fit system includes a fit strap or cable configured to engage a wearer's head and having two opposing ends, a first end configured to attach to the left side region and a second end configured to attach to the right side region. An actuator of the adjustable fit system is configured to attach to the left or right side region of the helmet and be operably connected to the fit strap or cable so that actuating the actuator selectively increases or decreases a length of the fit strap or cable in order to selectively loosen or tighten the fit strap or cable, respectively, relative to the wearer's head.

19 Claims, 11 Drawing Sheets

(58) Field of Classification Search
USPC ..... 2/417
See application file for complete search history.

(56) References Cited

U.S. PATENT DOCUMENTS

| | | | | |
|---|---|---|---|---|
| 3,916,446 | A | 11/1975 | Gooding | |
| 4,890,338 | A | 1/1990 | Knabenhans | |
| 5,203,034 | A | 4/1993 | Foehl | |
| 5,373,588 | A * | 12/1994 | Hede | A42B 3/145 2/418 |
| 5,915,538 | A | 6/1999 | Basson et al. | |
| 5,983,405 | A | 11/1999 | Casale | |
| 6,256,798 | B1 | 7/2001 | Egolf et al. | |
| 6,711,751 | B1 | 3/2004 | Muskovitz | |
| 6,934,971 | B2 | 8/2005 | Ide et al. | |
| 7,865,968 | B2 * | 1/2011 | Lilenthal | A42B 3/225 2/8.2 |
| 8,032,993 | B2 | 10/2011 | Musal | |
| 8,438,668 | B2 | 5/2013 | Garneau et al. | |
| 9,021,616 | B2 | 5/2015 | Baty | |
| 9,622,532 | B2 * | 4/2017 | Tryner | A42B 3/205 |
| 9,622,535 | B2 | 4/2017 | Windham et al. | |
| 11,089,831 | B1 | 8/2021 | Hermansen et al. | |
| 12,317,947 | B2 | 6/2025 | Hermansen et al. | |
| 2005/0204456 | A1 * | 9/2005 | Piper | A42B 3/00 2/411 |
| 2010/0170068 | A1 | 7/2010 | Musal | |
| 2012/0167290 | A1 | 7/2012 | Kovacevich et al. | |
| 2012/0278976 | A1 | 11/2012 | Benton | |
| 2013/0239303 | A1 * | 9/2013 | Cotterman | A42B 3/324 2/417 |
| 2013/0283507 | A1 * | 10/2013 | Baty | A42B 3/14 2/416 |
| 2013/0312163 | A1 | 11/2013 | Van Waes | |
| 2015/0033457 | A1 | 2/2015 | Tryner et al. | |
| 2016/0165998 | A1 | 6/2016 | Musal et al. | |
| 2016/0174648 | A1 | 6/2016 | Garneau et al. | |
| 2016/0270470 | A1 | 9/2016 | Hickman et al. | |
| 2018/0352909 | A1 | 12/2018 | Fava | |
| 2019/0297985 | A1 | 10/2019 | Weber et al. | |
| 2020/0275723 | A1 | 9/2020 | Pritz et al. | |
| 2021/0153594 | A1 | 5/2021 | Rogers et al. | |
| 2021/0154560 | A1 | 5/2021 | Tryner et al. | |
| 2021/0251328 | A1 | 8/2021 | Roberts | |
| 2022/0015488 | A1 | 1/2022 | Adams et al. | |
| 2022/0175074 | A1 | 6/2022 | Rietdyk | |
| 2023/0180878 | A1 | 6/2023 | Robbins et al. | |
| 2024/0065361 | A1 | 2/2024 | Muskovitz | |
| 2025/0000193 | A1 | 1/2025 | Muskovitz | |

FOREIGN PATENT DOCUMENTS

| | | | |
|---|---|---|---|
| EP | 0937416 | A2 | 8/1999 |
| FR | 2838611 | A1 | 10/2003 |
| WO | 2011/051989 | A1 | 5/2011 |

OTHER PUBLICATIONS

"The Best Ballistic Helmet Chinstraps & Retention Systems", Mar. 14, 2018, 12 Pages.

International Search Report and Written Opinion received for PCT Patent Application No. PCT/US23/72874, mailed on Nov. 16, 2023, 14 pages.

* cited by examiner

ADJUSTABLE FIT SYSTEMS FOR USE WITH PROTECTIVE HELMETS AND HELMET AND ADJUSTABLE FIT ASSEMBLIES

CROSS-REFERENCE TO RELATED APPLICATION

This Application claims the benefit of U.S. Provisional Application No. 63/621,452, filed Jan. 16, 2024, and U.S. Provisional Application No. 63/534,312, filed Aug. 23, 2023, which are incorporated herein by reference in their entirety.

BACKGROUND

Technical Field

This disclosure generally relates to protective helmets and, more specifically, to adjustable fit systems for use with protective helmets and helmet and adjustable fit assemblies.

Related Technology

Protective helmets are well known and may be worn when participating in a wide variety of activities. For example, helmets are typically worn to protect the wearer's head and brain during cycling, snowboarding, skiing, skateboarding, rock climbing, football, baseball, field hockey, ice hockey, horse riding, scooter riding, motorcycle riding, military action, and construction sites, just to name a few. Damage and injury can be prevented or reduced by protective headwear that prevents hard, rough, or sharp objects from coming into direct contact with a user's head. Damage and injury can also be prevented by protective headwear that absorbs and distributes the energy of an impact.

An aspect many articles of protective headwear include, particular bicycle helmets, is a fit system that wraps around at least a portion of the wearer's head. Fit systems assist in keeping the safety helmet securely attached to the wearer's head and assist in ensuring a comfortable fit for the wearer. Fit systems may include foam or cloth pads to enhance fit without sacrificing comfort. Fit systems may reduce and/or eliminate vertical movement of the safety helmet from the wearer's head and may also prevent pivoting of the safety helmet out of position when secured to the wearer's head, ensuring that the vulnerable portions of a wearer's head are not exposed to impact and injury.

A fit system may include one or more fit straps, which can include cables, fabric, or plastic components. The fit strap can be continuous or divided into multiple pieces. The fit system includes an adjustment mechanism. The adjustment mechanism is located in the center of the fit system at the back of the occipital bun of the wearer's head. Engaging the adjustment mechanism, typically a rotatable dial, allows the wearer to selectively reduce or increase the circumference of the fit strap within the protective helmet, providing a more customized fit. The fit system is made of multiple pieces or parts of flexible or rigid material. Each section of the fit strap is connected to the adjustment mechanism at one end and to the helmet at a second end. The two second ends may be located behind the ears of the wearer. The fit system is configured so that engagement of the adjustment mechanism changes the size of the lateral offset between the two second ends. Because the adjustment happens at the occipital bun, any adjustments must be made by the wearer reaching a hand behind the wearer's head to turn the dial. This can be awkward and difficult while engaging in an activity. In some cases, the wearer must cease the activity and adjust the fit system before resuming the activity.

Several types of safety helmets undergo a series of safety tests and are required to meet certain safety standards in order to be sold on the market. Safety tests generally measure how well a helmet manages energy absorption and redistribution around the wearer's head. Common safety tests are the drop or impact test, the roll-off test, and the elongation or retention test.

While conventional safety helmets may meet certain safety standards when the straps are adjusted correctly, very few users actually use them in a correctly adjusted configuration. Some adjustments may be performed when the helmet is removed from the wearer's head, which may require trial and error testing to achieve the correct adjustment. Typically, even with several adjustment attempts, the fit system may be loose, which may allow the protective helmet to become dislodged in the event of impact. Furthermore, some wearers may be unwilling to adjust the fit system to be as tight as it should be because a requisite level of tightness may not be comfortable and much of the time, the user may not be engaging in the most dangerous part of their activity which would require a tight fit. Furthermore, phenomena incident to engaging in an activity (e.g., perspiration between the wearer's head and the safety helmet) may cause the fit of the safety helmet to change. Therefore, many users may wear their helmet with the fit system incorrectly adjusted and/or too loose, even when they know they are about to engage in the most dangerous part of their activity. Undoubtedly, such improper fitting of conventional fit system may cause a significant number of head trauma injuries, and in some cases, deaths. Approximately 30% of all injury-related deaths are a result of traumatic brain injuries.

During use of the helmet, the tightness of the fit system may also need to be adjusted by the wearer. Placement of the adjustment mechanism at the back of the head may prevent or hinder wearers from adjusting the tightness of the fit system in real time. For example, an adjustment mechanism at the back of the head can be difficult to reach while riding a bike, meaning a wearer may not be able to readily and accurately adjust the fit of their helmet in real time without awkward body contortions. Compounding this problem is that, during use, fit systems composed of certain fabrics may become sweat-soaked, bacteria-ridden, and stretched out. The wearer my simply opt to have a sub-optimally fitting helmet for reasons given above, with the attendant risk and dangers of head trauma injury or even death.

Another drawback of conventional fit systems is the inability of the systems to be implemented in a wide variety of protective headwear articles. For example, placing an adjustment mechanism at the back of a protective headwear article has limited utility in situations in which the wearer needs to adjust the fit while riding a bike, operating dangerous machinery, etc.

In view of the foregoing, there is a long-felt but unsatisfied need for improved helmet retention systems, particularly fit systems for customizing the fit of a generically sized helmet to a particular wearer.

SUMMARY

Disclosed are adjustable fit systems for use with protective helmets and helmet and adjustable fit assemblies that solve some or all of the problems of the prior art. Specifically, the adjustable fit systems include an elongated fit strap configured to engage a wearer's head and an actuator, wherein the actuator is operably connected to at least one end of the fit strap to permit a wearer to selectively increase or decrease the length of the fit strap to loosen or tighten the adjustable fit system relative to the wearer's heard.

In some embodiments, an adjustable fit system for use with a protective helmet includes an actuator in direct operable communication with the fit strap, such that actuating or otherwise manipulating the actuator selectively increases or decreases the length of the fit strap. In some embodiments, the actuator may releasably engage the shell of a protective helmet and may enable the fit strap to releasably engage the helmet shell. In some embodiments, the fit strap is a substantially single continuous material extending between opposing first and second ends, or it may contain a main strap or cable with attached padding or other comfort-enhancing features. The actuator may comprise a detent, pawl and ratchet, spring pump, wheel, buckle, pinion gear, or other means for operably engaging, and increasing or decreasing the length of, the fit strap.

In some embodiments, the ends of the fit strap may be inserted into one or more anchor sleeve or ducts, which are positioned in a housing that is part of an isolated fit system, which form part of the helmet, or are configured to be inserted into channels within the helmet shell. When decreasing the length of the fit strap, an extra length of fit strap can be housed in or received internally by the helmet shell. For example, the helmet shell may include a channel, groove, and/or space in or between the inner and/or outer components of the shell to receive an excess portion of the fit strap when shortened. In some embodiments, the inner and/or outer component of the helmet shell may include a groove to receive the fit strap as it is being shortened and to guide an end of the fit strap, for example, away from the wearer's head. In some embodiments, the fit strap may be received into a space between the helmet shell and the wearer's head. In this way, the fit strap may remain entirely contained within the helmet, with no ends of the fit strap poking out or being externally accessible. In some embodiments, the extra length of the fit strap can be external to the helmet and not contained within the helmet shell.

In some embodiments, the adjustable fit system may comprise anchor sleeves or ducts configured to receive the opposing ends of the fit strap and enable quick attachment of the fit strap to the helmet shell. In some embodiments, a rear portion of the fit strap may be received by a rear anchor sleeve or duct configured to prevent the fit strap from traveling over the wearer's head.

In some embodiments, the fit strap can include an adjustable length fit strap cable attached to webbing for comfort. In some embodiments, the adjustable length fit strap cable can be a single-stranded cable fixed at one side of the helmet and attached to the actuator at the opposite side of the helmet. In other embodiments, the adjustable length fit strap cable can be a multi-stranded (e.g., dual-stranded) cable that interacts with a length equalizing wheel at one side of the helmet with two ends attached at the opposite side of the helmet, with one end being fixed to the helmet and the other end attached to the actuator.

In some embodiments, the fit strap can include an adjustable length fit strap cable that is at least partially enclosed within a position retention sheath. The position retention sheath is configured and have a stiffness to retain an otherwise flexible and freely movable fit strap cable in a desired position relative to the helmet. The position retention sheath helps manage the location of the fit strap cable in order to assist the user in installing and removing the helmet by minimizing difficulties caused by unpredictable movements or positioning of an otherwise flaccid or less stiff fit strap cable.

In some embodiments, the inner and outer components of the helmet shell can be joined together to create a substantially uniform helmet. In some embodiments, the inner and outer components of the helmet shell are formed/manufactured together as one piece. In some embodiments, the inner and outer components of the helmet shell are constructed from the same material. In some embodiments, the inner and outer shell components of the helmet are two distinct, separate pieces joined together to create the helmet shell. In some embodiments, the inner and outer components of the helmet shell are constructed from different materials. For example, a flexible polystyrene or other polymeric inner component can be in-molded with an outer and harder shell component.

In some embodiments, a protective helmet and adjustable fit assembly comprises:

- a protective helmet configured to at least partially cover a wearer's head, wherein the protective helmet includes:
  - a helmet shell, optionally comprising an outer shell component and an inner shell component;
  - a front and a back; and
  - a left side region and a right side region; and
- an adjustable fit system including:
  - a fit strap configured to attach to the helmet shell, engage a wearer's head, and having two opposing ends, a first end configured to attach to the left side region and a second end configured to attach to the right side region; and
  - an actuator configured to attach to the left or right side region of the helmet shell and be operably connected to the fit strap so that actuating the actuator selectively increases or decreases a length of the fit strap in order to selectively loosen or tighten the fit strap, respectively, relative to the wearer's head.

In other embodiments, an adjustable fit system configured for use with a protective helmet comprises:

- a fit strap configured to attach to a helmet shell, engage a wearer's head, and having two opposing ends, a first end configured to attach to a left side region of the helmet shell and a second end configured to attach to a right side region of the helmet shell; and
- an actuator configured to attach to the left or right side region of the helmet shell and be operably connected to the fit strap so that actuating the actuator selectively increases or decreases a length of the fit strap in order to selectively loosen or tighten the fit strap, respectively, relative to the wearer's head.

In some embodiments, the actuator may comprise a slider, detent, spring pump, pawl and ratchet, wheel, pinion gear, or other means for selectively increasing or decreasing the length of the fit strap. The actuator can be attached to an outer component of the helmet at a first side region of the helmet shell and operably connected to one of the opposing ends of the fit strap, with the opposing end of the fit strap being attached to an opposite side region of the helmet shell.

By way of example and not limitation, the adjustable fit system may include a linear gear attached to or forming part of the fit strap at or near one of the two opposing ends. In this embodiment, the actuator can include a rotatable wheel attached to a pinion gear configured to engage the linear gear of the fit strap such that selectively rotating the actuator in a first direction shortens the fit strap and rotating the actuator in an opposite direction lengthens the fit strap.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale, wherein:

DETAILED DESCRIPTION

Figure 1A:
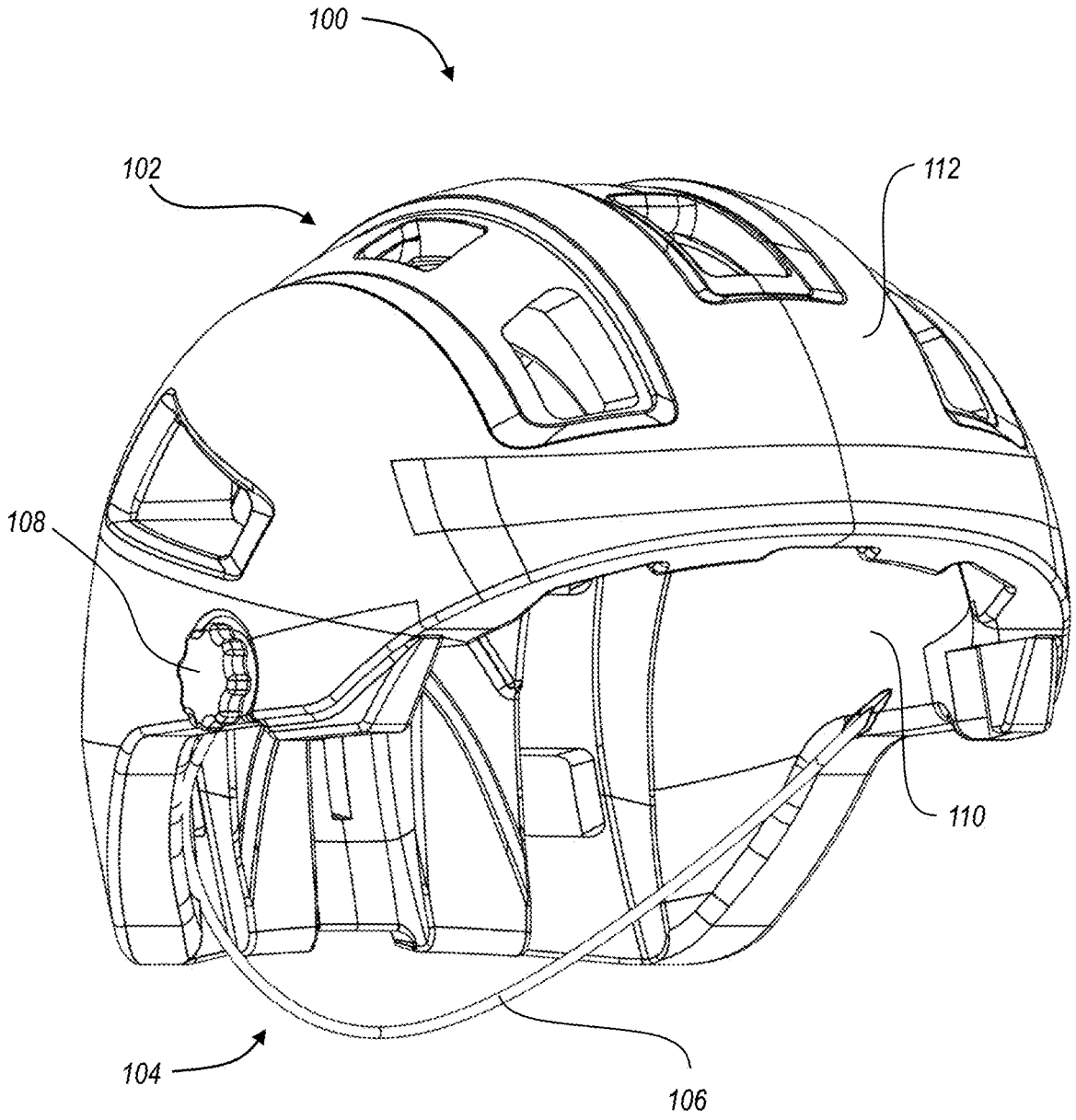
FIG. 1A schematically illustrates an embodiment of a protective helmet and adjustable fit assembly, which includes a single-stranded adjustable fit strap cable.

Disclosed are helmet and adjustable fit assemblies and adjustable fit systems for use with protective helmets that solve some or all of the problems of the prior art. The adjustable fit system is configured to allow a wearer to easily adjust and optimize the fit of a protective helmet in real time while engaging in an activity.

In some embodiments, a helmet and adjustable fit assembly includes a protective helmet and an adjustable fit system attached to or integrated with the helmet, wherein the fit system includes an elongate fit strap configured to engage a wearer's head and an actuator positioned at a side of the protective helmet. The actuator is operably connected to and interacts with the fit strap to adjust the length of the fit strap in order to adjust and optimize the fit of the helmet to the wearer's head.

In some embodiments, adjustable fit systems are configured for use with a protective helmet. The adjustable fit systems can be configured to cleanly and easily attach to a helmet, wherein a fit strap of the adjustable fit system includes two opposing ends. A first opposing end of the fit strap can be anchored to a housing that can be permanently or removably attached to or positioned at a first side of a helmet, and a second opposing end can be operably connected to and interact with an actuator connected to a housing that can be permanently or removably attached to or positioned at a second side of the helmet (e.g., opposite the first side).

In some embodiments, the actuator is operably connected to the fit strap, such that actuating or otherwise manipulating the actuator can quickly and easily increase or decrease the length of the fit strap in real time, such as while the wearer is riding a bike, skiing, climbing, or engaging in other sporting events or activities, to achieve optimal comfort, tightness, and fit of the helmet. In some embodiments, the actuator may releasably engage the helmet to enable the fit strap to releasably engage the helmet to facilitate installation and removal of the helmet from the wearer's head. In other embodiments, an end of the fit strap opposite the actuator may releasably engage the helmet. In some embodiments, the fit strap can be a single, continuous strap extending between opposing first and second ends. In other embodiments, the fit strap may be formed from multiple segments or sections. In some embodiments, when decreasing the length of (and, thus tightening) the fit strap, an extra length of the fit strap can be received or housed internally within the helmet shell.

The helmet, more particularly the helmet shell, is configured to at least partially cover a wearer's head. The helmet shell may comprise an inner shell component and an outer shell component. The outer shell component may have a greater rigidity than the inner shell component, the outer shell component being configured to resist the force of an impact. The inner shell component may be configured to absorb the force of an impact or otherwise slow the application of the impact to the wearer's head. The inner shell component may also be configured to interface directly with the wearer's head.

In some embodiments, an inside surface of the outer shell component of the helmet shell can include a channel configured to receive a portion of the fit strap as it is being shortened, and to guide the portion of the fit strap, for example, away from the wearer's head. In some embodiments, an outside surface of the inner shell component can include a channel to receive the portion of the fit strap as it is being shortened to guide the fit strap, for example, away from the user's head. In some embodiments, the fit strap can be received into a channel comprising a space between the inner and outer shell components. In some embodiments, the fit strap can be received into a channel comprising a space between the inner shell component and the user's head. In this way, the fit strap may remain entirely contained within the shell or helmet assembly, with no ends of the fit strap extending external to the helmet or being externally accessible. In some embodiments, the extra length of the fit strap can be external to the helmet and not contained within the helmet shell. In some embodiments, the extra length of the fit strap may be configured to be grasped and pulled by the wearer to easily tighten the fit strap. The extra length of the fit strap may comprise a mechanism, such as a loop or a tag having a tactile surface, to facilitate grasping of the extra length by the wearer.

In some embodiments, both ends of the fit strap may be removably or non-removably connected to the helmet shell. In some embodiments, both ends of the fit strap can be removably or non-removably anchored between the inner and outer shell components of the helmet. In some embodiments, both ends of the fit strap can be removably or non-removably anchored to the inner shell component. In some embodiments, both ends of the fit strap can be removably or non-removably anchored to the outer shell component of the helmet. In some embodiments, the fit strap can be one continuous strap extending between left and right side regions of the helmet and being adjustable in length via the actuator without any portion being detached. In another embodiment, an end of the fit strap may comprise prongs, barbs, or similar mounting hardware to enable selective insertion and retention of the end of the fit strap in the helmet shell. This insertion and retention may be permanent in nature or may be reversible to allow for the quick detachment of at least one end of the fit strap from the helmet.

To install or remove the helmet, the wearer can simply lengthen the fit strap until the helmet can be installed over or removed from the wearer's head unhindered by the fit strap. After installing the helmet with the loosened strap, the wearer can then shorten (tighten) the fit strap using the actuator to achieve a comfortable and sufficiently tight fit. Conversely, the installed helmet can be removed by loosening and/or detaching the fit strap and removing the helmet from the wearer's head.

The helmet and adjustable fit assembly and adjustable fit system for use with a protective helmet each comprise an actuator configured to facilitate tightening of the fit strap. In some embodiments, the actuator may be positioned or positionable on or at a side region of the helmet. For example, the actuator may be accessed at approximately a left side region or ear area or a right side region or ear area of the helmet. In some embodiments, the entirety of the actuator may be accessed at or near a left side or right side region or ear area of the helmet. In some embodiments, a portion of the actuator may be concealed by or embedded in the helmet shell.

In some embodiments, only one end of the fit strap may be non-removably anchored to the helmet shell. For example, the anchored end may be anchored between the inner and outer shell components of the helmet. Alternatively, the anchored end may be anchored to one of the inner or outer shell components of the helmet. Alternatively, the anchored end may be anchored to one of the inner or outer shell components of the helmet. The other end can be engageable with the helmet (the inner shell component, the outer shell component, or both) and can be removed from the helmet to have a free hanging fit strap end (still anchored by the other end). In some embodiments, the detachable end of the fit strap may removably attach to the helmet via the actuator. In other embodiments the detachable end of the fit strap may removably engage with the helmet via a buckle, snap, or other connection feature, with the non-removeable end being attached to the helmet via the actuator.

Embodiments of the disclosure provide a number of benefits, technical solutions, and advantages over prior art helmets and fit systems. For example, the disclosed adjustable fit systems enable more accurate and easy adjustment of the fit strap and more accurate or proper fit of the helmet to the wearer. Adjustments can be made quickly and easily using one hand and without having to awkwardly reach to the back of the helmet or remove the helmet from the wearer's head. This facilitates real time adjustments while engaging in an activity. Providing an accurate and proper fit beneficially leads to a decrease in both head trauma injuries and the severity of any head trauma injuries. For example, a 66% decrease of serious head injuries may be realized by proper helmet fit.

In addition, a more accurate and proper fit provides a more comfortable fit, meaning the user is more likely to properly wear the helmet during dangerous activities or during more dangerous parts of some activities. Further, the disclosed adjustable fit systems and helmet and fit assemblies are applicable across a wide variety of helmet types, such as construction, bicycle, ski and snowboard, sports (e.g., American football, hockey, or lacrosse helmets), and motorcycle helmets, among others. Further, the adjustable fit system can be contained inside and about the helmet, beneficially providing a cleaner and more aerodynamic profile. Additionally, there are no external parts to get caught or dragged while wearing and using the helmet and adjustable fit assemblies.

Reference is now made to the Figures, which illustrate embodiments of helmet and adjustable fit assemblies, and adjustable fit systems configured for use with a helmet, that facilitate adjustment of the length and fit of the fit strap relative to a wearer's head via a readily accessible actuator on a side region of the helmet that can advantageously be manipulated using one hand. It shall be understood that the Figures are illustrative only and not limiting. In addition, features shown in one Figure can be used in combination with features from one or more other Figures without limitation as long as such combination is operable and useful to achieve the purposes disclosed herein. Thus, any feature shown in one Figure can provide enabling disclosure when combined with any feature from one or more Figures.

Figure 1B:
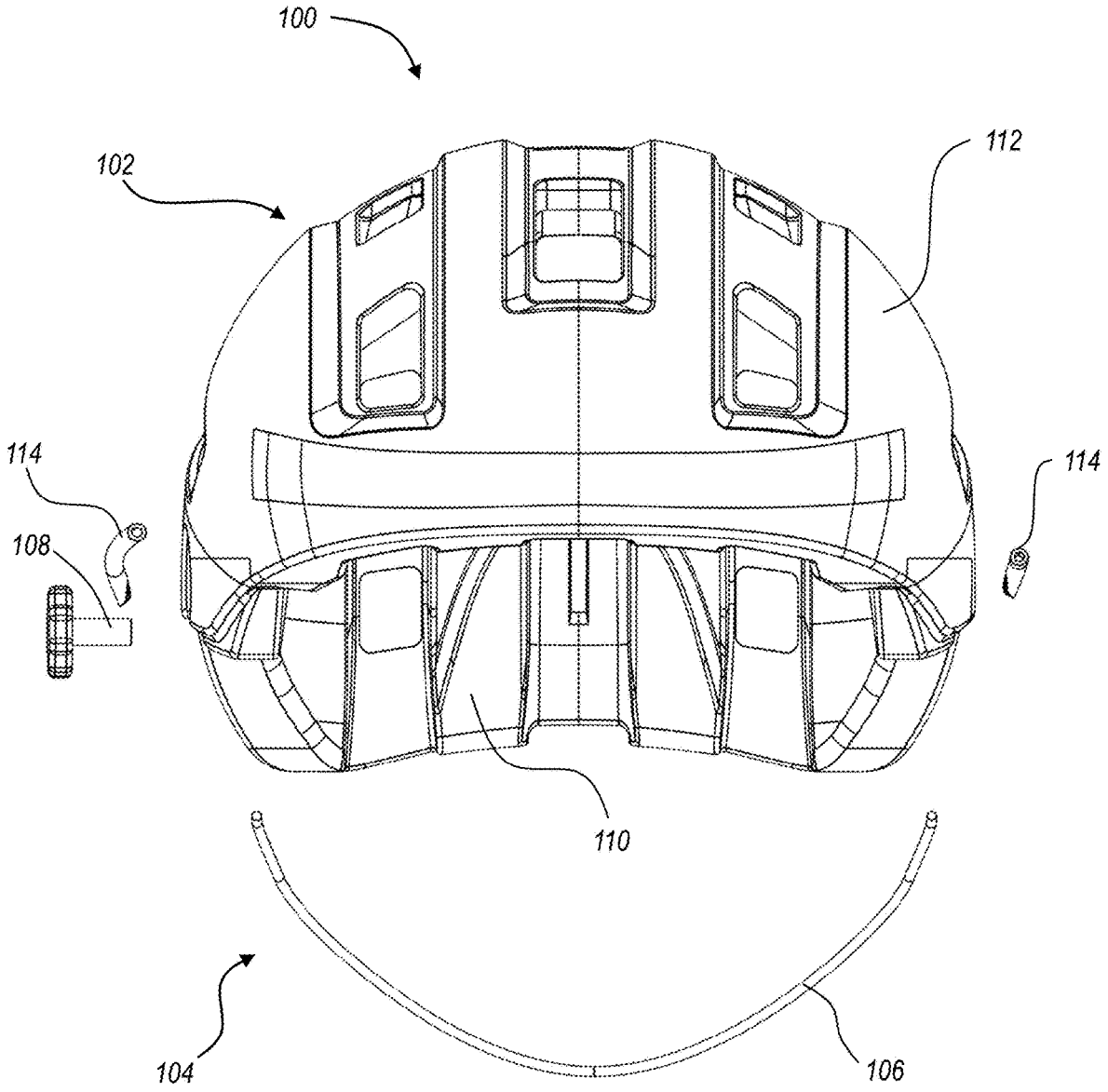
FIG. 1B is an exploded view of the protective helmet and adjustable fit assembly of FIG. 1A.

FIGS. 1A and 1B schematically illustrate an embodiment of a helmet and adjustable fit assembly 100 of the present disclosure. With reference to FIG. 1A, the helmet and adjustable fit assembly 100 includes a helmet shell 102 and an adjustable fit system 104. The fit system 104 includes a fit strap 106 and an actuator 108. The adjustable fit system 104 is schematically illustrated as including a single-stranded fit strap cable 106, which can be advantageously enclosed within webbing, and/or woven material (e.g. cotton, polyester, or a blend) for comfort. However, it shall be understood that the adjustable fit system 104 can simply include a single component fit strap 106 that does not include or is not in the form of a cable. In either case, the fit strap or single-stranded fit strap cable 106 is fixed at one side of the helmet shell 102 and attached to the actuator 108 at the opposite side of the helmet shell 102.

The helmet shell 102 may include an inner shell component 110 and an outer shell component 112. In some embodiments, the outer shell component 112 can be a relatively hard, rigid layer, and the inner shell component 110 can be a softer liner attached or joined to the outer shell component 112. In some embodiments, the inner shell component 110 may include a harness or suspension system configured to comfortably engage the wearer's head. In some embodiments, the inner shell component 110 may include foam (e.g., expanded polystyrene or polyurethane), fabric, and/or padding. In some embodiments, the helmet shell 102 may further include a lining (not illustrated) that attaches and provides additional padding to the inner shell component 110. In some embodiments, the inner shell component 110 can be directly attached or bonded to the outer shell component 112, such as by in-molding, in order for the inner and outer shell components to form a composite system in which the shell components reinforce each other. In some embodiments, there can be a gap or space between the inner and outer shell components 110, 112 such as to receive a portion of the fit strap 106.

In some embodiments, both the inner and outer shell components 110, 112 are molded and thermoformed into a desired shape. In some embodiments, the inner and outer shell components 110, 112 can be in-molded together as a composite piece. In other embodiments, the inner and outer shell components 110, 112 can be formed separately and then joined together to create the helmet shell 102. For example, the outer shell component 112 can be molded and thermoformed into a desired shape, and the inner shell component 110 can then be in-molded within the outer shell component 112 or separately molded and then attached to the outer shell component 112. In some embodiments, the outer shell component 112 is solid and continuous (such as with a construction hard hat). In some embodiments, the outer shell component 112 includes vents or gaps (such as with a bicycle or ski helmet).

The adjustable fit system 104 includes a fit strap 106 and an actuator 108 operably connected to the fit strap 106. As illustrated, the actuator 108 can be side accessible and easy to reach and manipulate, thereby enabling ready adjustment of the length and tightness of the fit strap 106 relative to the wearer's head. For example, the actuator 108 may be positioned at or near a left or right side region, or a left or right ear area. The actuator 108 may include a slider, detent, spring pump, pawl, ratchet system, wheel, pinion gear, or other means for selectively increasing or decreasing the length of the fit strap 106. As illustrated in FIGS. 1A, 1B and 2, the actuator 108 may comprise a wheel having a gear-like profile to facilitate manipulation of the actuator 108. In some embodiments, the actuator 108 may comprise a tactile surface, such as a surface comprising bumps or an abrasive material. Alternatively, or additionally, the actuator 108 may comprise knurling or scalloping to facilitate manipulation of the actuator 108 by a wearer.

In the case of a rotatable actuator 108, rotation in a first direction may tighten the fit strap 106 and rotation in a second direction opposite the first direction may loosen the fit strap 106. In some embodiments, the actuator 108 may comprise a first configuration or position in which the actuator 108 operably engages the fit strap 106 to tighten or loosen the fit strap 106 in a first manner. In some embodiments, the actuator 108 may be configured to be moved to a second configuration or position in which the actuator 108 engages the fit strap 106 in a second manner, such as to tighten or loosen the fit strap 106 at a different rate than when the actuator 108 is in the first first configuration position. For example, the actuator 108 may be configured to provide gross adjustment of the fit strap 106 when in the first configuration or position and to provide fine adjustment of the fit strap 106 when in the second configuration or position.

Alternatively, or additionally, the actuator 108 may be configured to be moved or placed into a third configuration or position in which the actuator 108 is not engaged with the fit strap 106, such that a portion of the fit strap 106 may move freely, such as within a channel or duct on or in the helmet shell 102. Such a fit system may facilitate quick removal of the helmet assembly 100 by the wearer. In some embodiments, the helmet assembly 100 may include multiple actuators 108, such as first and second actuators 108 attached to opposite ends of the fit strap 106 and positioned on opposite sides of the helmet, wherein the first actuator can be configured to provide gross adjustment of the fit strap 106 and the second actuator can be configured to provide fine adjustment of the fit strap 106 (e.g., such as by having coarse and fine gear teeth, respectively).

In some embodiments, both ends of the fit strap 106 can be non-removably anchored to or between the inner and outer shell components 110, 112 of the helmet shell 102. Specifically, the fit strap 106 may be configured to only be adjustable in length via the actuator 108. To install or remove the helmet assembly 100, a wearer can simply lengthen and loosen the fit strap 106 until the helmet shell 102 and fit strap 106 can fit over and around the wearer's head, the fit strap 106 encircling a back portion of the wearer's head. After initially installing the helmet shell 102 over the wearer's head, the wearer can shorten and thereby tighten the fit strap 106 via the actuator 108 to achieve a comfortable and properly tight fit for comfort and safety, the fit strap 106 functioning to urge the head against a front inner surface of the helmet shell 102 and/or a front surface of the fit strap. The actuator 108 may be accessed on a side region of the helmet shell 102—either at approximately a left ear area or approximately a right ear area (as shown). In some embodiments, the left and/or right ear areas encompass a left and/or right ear perimeter of the shell 102 as well as the ear of the wearer.

FIG. 1B is an exploded view of the helmet and adjustable fit assembly 100 of FIG. 1A. The helmet and adjustable fit assembly 100 includes a helmet shell 102 and an adjustable fit system 104, which includes a fit strap 106 and an actuator 108. The helmet shell 102 includes inner and outer shell components 110, 112. As illustrated, the actuator 108 is side accessible, easy to reach and turn, enabling easy adjustment by the wearer to loosen or tighten the fit strap 106 in real time. A wearer can easily access and manipulate the actuator 108 without having to remove the helmet assembly 100 and without having to turn or contort their body to do so while engaging in activities.

In some embodiments, the fit strap 106 may connect to the helmet shell 102 between the inner and outer shell components 110, 112 of the helmet shell 102. In some embodiments, the fit strap 106 can be configured to pivot about a hinge point located between the inner and outer shell components 110, 112 of the helmet shell 102 where the fit strap 106 connects to the helmet shell 102. In some embodiments, the fit strap 106 may connect to the outer shell component 112 of the helmet shell 102 and be configured to pivot about a hinge point where the fit strap 106 connects to the outer shell component 112. For example, in some embodiments, the fit strap 106 may connect to an inner surface of the outer shell component 112. In some embodiments, the fit strap 106 may connect to the inner shell component 110 of the helmet shell 102 and be configured to pivot about a hinge point where the fit strap 106 connects to the inner shell component 110. For example, the fit strap 106 may connect to an outer surface of the inner shell component 110.

The adjustable fit system 104 may include at least one anchor sleeve or duct 114. The adjustable fit system 104 illustrated in FIG. 1B includes two anchor sleeves or ducts 114. The anchor sleeves or ducts 114 are configured to receive and/or retain the opposing ends of the fit strap 106 at the left ear area, the right ear area, or both. The anchor sleeves or ducts 114 are configured to provide a space or channel for the opposing ends of the fit strap 106 of the adjustable fit system 104 to be hidden and slide within an interior of the helmet shell 102. The anchor sleeves or ducts 114 can be configured to anchor the opposing ends of the fit strap 106 to the helmet shell 102. For example, the anchor sleeves or ducts 114 may be simple slots or channels that engage the opposing ends of the fit strap 106. The slots or channels may be integral to the inner and/or outer shell components 110, 112. The anchor sleeves or ducts 114 may be one-way push-to-connect type sleeves or ducts, where an end of the fit strap 106 is inserted into the anchor sleeve or duct 114, becomes engaged with the anchor sleeve or duct 114, and cannot be pulled out of the anchor sleeve or duct 114. The anchor sleeves or ducts 114 may be a detent-type slot, where a pin on one end of the fit strap 106 engages with a hole in the anchor sleeve or duct 114. To remove the end of the fit strap 106, the user would simply push the pin through the hole and pull on the fit strap 106 to remove the end of the fit strap 106. In some embodiments, the anchor sleeves or ducts 114 may be simple channels defined by the inner and outer shell components 110, 112 of the helmet shell 102 rather than being additional and/or discrete pieces.

The anchor sleeves or ducts 114 may be configured to enable the actuator 108 to remain in operable communication with the fit strap 106 at either the left or right ear area. The anchor sleeves or ducts 114 may be in-molded to the helmet shell 102 or may be removable, separate pieces. In some embodiments, the anchor sleeves or ducts 114 may be formed of a hard and rigid material, such as plastic or metal, to prevent the deformation of the anchor sleeves or ducts 114 during use. Additionally, and/or alternatively, the anchor sleeves or ducts 114 may be slots, channels, or grooves defined by either the inner or outer shell components 110, 112, or both. Beneficially, incorporating the anchor sleeves or ducts 114 into the helmet shell 102, or into either the inner or outer helmet shell components 110, 112, effectively hides them from view and simplifies the overall look of the helmet and adjustable fit assembly 100. Further, positioning the anchor sleeves or ducts 114 (or the defined grooves) into the helmet shell 102 leaves the inner surface of the helmet shell 102 clean and smooth, adding to the comfort level of the helmet and adjustable fit assembly 100.

The fit strap 106 may be constructed from a cable, a strap, webbing, and/or woven materials (e.g., cotton, polyester, or a blend). The fit strap 106 may be a single, continuous strap, or may be formed from multiple or interlocking straps. In some embodiments, at least a portion of the fit strap 106 may be substantially flat, allowing for an ergonomic fit against the back of wearer's head. In another embodiment, at least a portion of the fit strap 106 may be made of silicon, rubber, or plastic material. This material can allow for the fit strap 106 to maintain a more rigid shape or allow for the fit strap 106 to maintain a more secure mechanical communication with an actuator 108. Some materials may have anti-microbial properties, which provide the wearer the benefit of simply wiping down the fit strap 106 after use without the need to rigorously clean the fit strap 106 to avoid microbial festering from sweat or other unwanted substances.

Figure 1C:
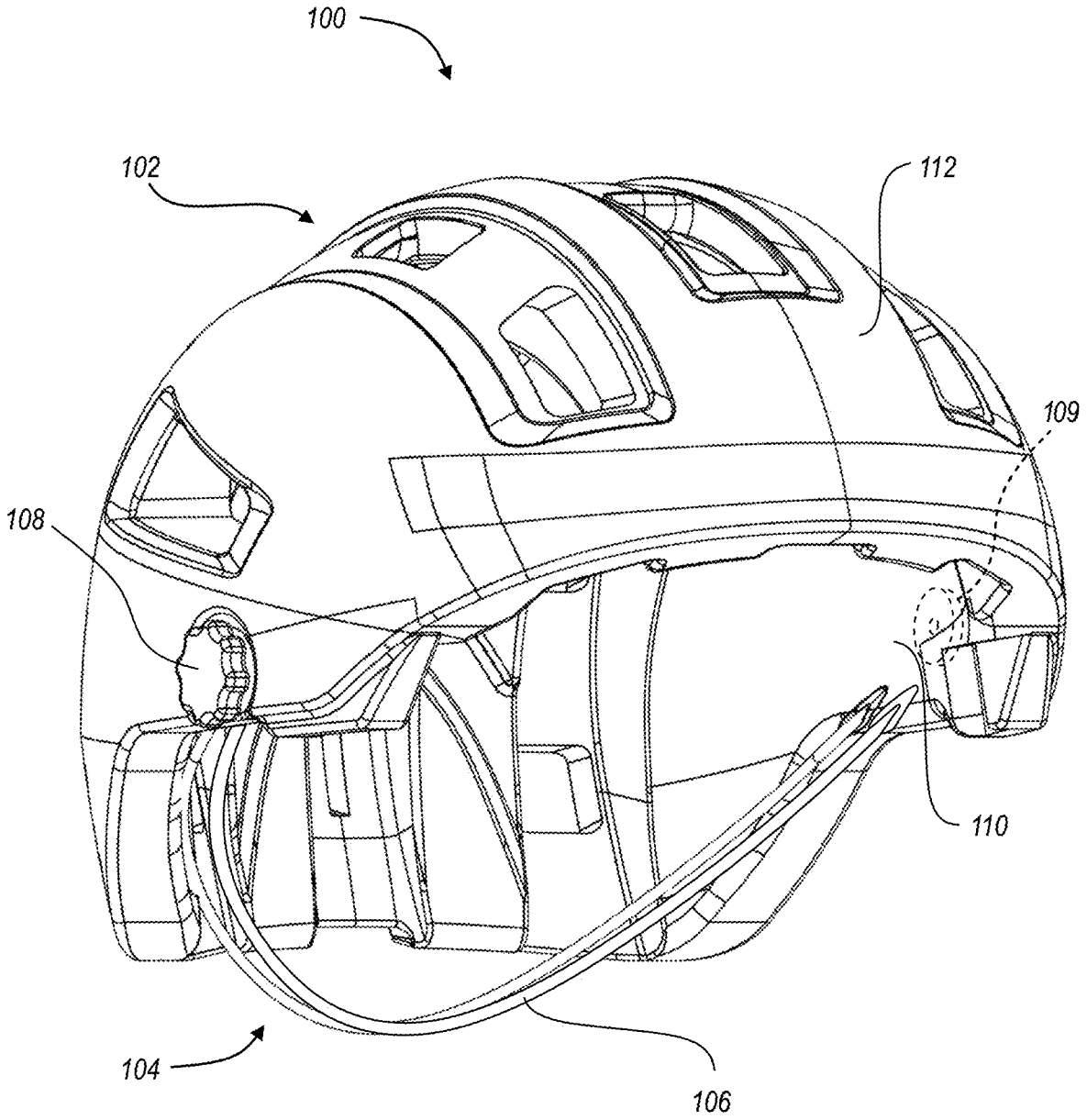
FIG. 1C schematically illustrates an embodiment of a protective helmet and adjustable fit assembly, which includes a dual-stranded adjustable fit strap cable.

FIG. 1C illustrates an alternative embodiment of a helmet and adjustable fit assembly 100 of the present disclosure, but in which adjustable fit assembly 104 includes a dual-stranded adjustable fit strap cable 106, which can be advantageously enclosed within webbing, and/or woven material (e.g. cotton, polyester, or a blend) for comfort. The dual-stranded fit strap cable 106 interacts with a length equalizing wheel 109 at one side of the helmet shell 102, with two ends attached at the opposite side of the helmet shell 102. One end of the dual-stranded fit strap cable 106 is fixed to the helmet by an anchor sleeve 114 and the other end is attached to the actuator 108, which permits the user to selectively shorten or lengthen the dual-stranded fit strap cable 106.

The dual-stranded fit strap cable 106 in this embodiment functions much like a double pully to reduce the force required to turn the actuator to tighten the dual-stranded fit strap cable 106, which may permit more fine tuning of fit strap tightness by the user. Assuming the actuator 108 has the same configuration or length-altering diameter or ratio as in FIG. 1A, it would take twice as many turns of the actuator 108 to shorten or lengthen the dual-stranded fit strap cable 106. Of course, the actuator 108 can be altered to have a different length-altering diameter or ratio, such that fewer turns are required to shorten or lengthen the dual-stranded fit strap cable 106, as desired.

Figure 2A:
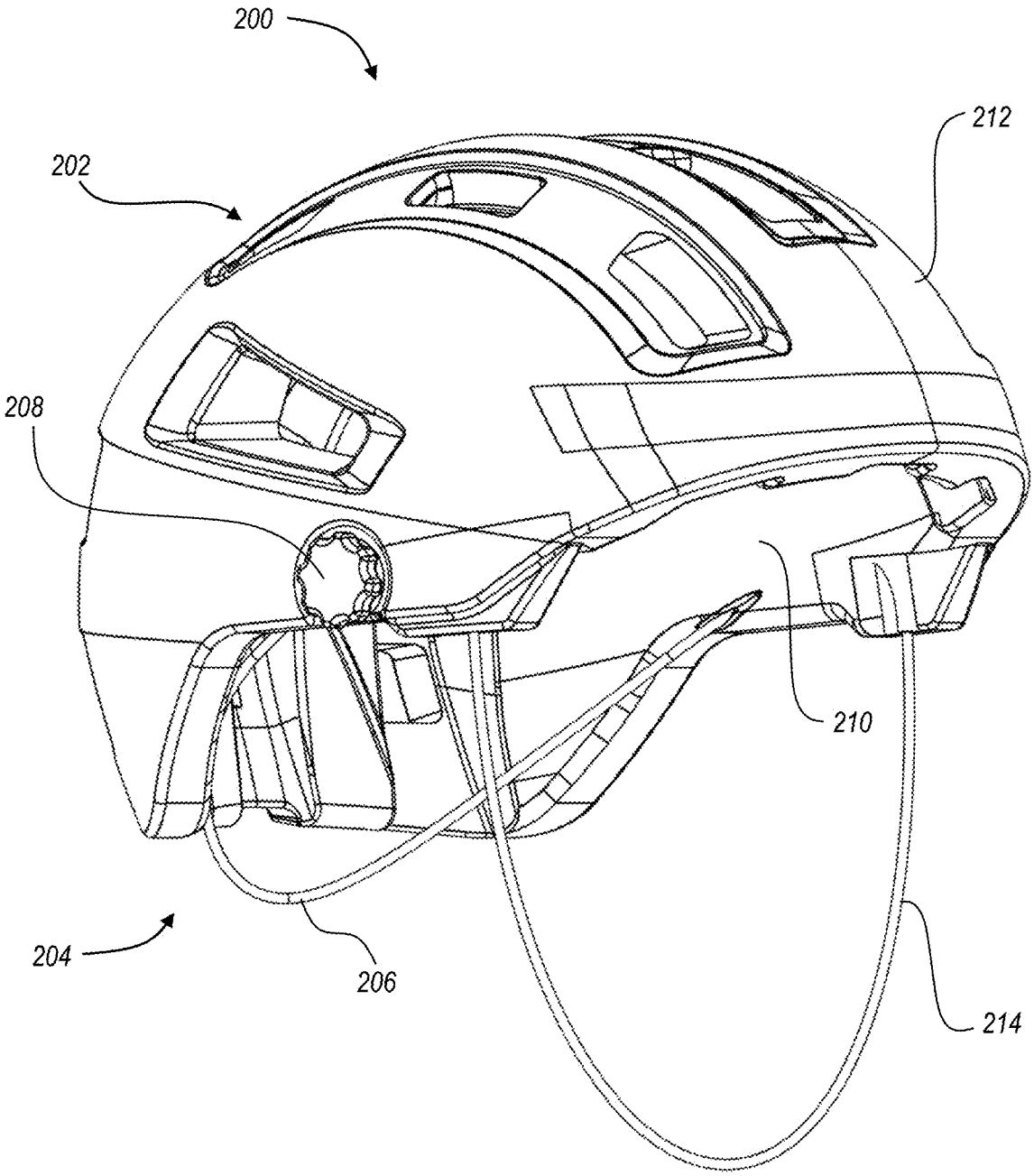
FIG. 2A schematically illustrates another embodiment of a protective helmet, adjustable fit assembly, and optional chin strap.

FIG. 2A illustrates another embodiment of a helmet and adjustable fit assembly 200. Similar to the embodiment in FIGS. 1A-1B, the helmet and adjustable fit assembly 200 of FIG. 2 includes a helmet 202, comprising an inner shell component 210 and an outer shell component 212, and an adjustable fit system 204, which includes a fit strap 206 and an actuator 208 operably connected to the fit strap 206 to adjust its length and tightness. As illustrated, in some embodiments the helmet and adjustable fit assembly 200 may include an optional chin strap 214 configured to secure the helmet 200 to the wearer's head and provide the wearer with an even more secure fit. In some embodiments, the fit strap 206 may be configured to secure the helmet 202 to the wearer's head. For example, the fit strap 206 may be configured to contact the occipital portion of the wearer's head to urge the helmet 200 down onto the wearer's head, the adjustable fit system 204 being the only or primary mechanism necessary to secure the helmet 200 to the wearer's head.

In some embodiments, the adjustable fit system 204 comprising the actuator 208 and fit strap 206 may be assembled and incorporated into the helmet 202 and/or shell components 210, 212 during manufacture. In other embodiments, the adjustable fit system 204 may be assembled before incorporation onto or into the helmet 202 to facilitate production and manufacture of the helmet 202. For example, the fit strap 206 and actuator 208 may be connected to one or more housings configured to be attached to or inserted into the helmet 202 to form the adjustable fit system 204 before being incorporated to form the helmet and adjustable fit assembly 200. Forming the adjustable fit system 204 together with the housings before assembly onto or into the helmet 202 enables the fit system to be modular, allowing for quick attachment of the adjustable fit system 204 to various types of helmets and/or accelerate the assembly process during manufacture.

Figure 2B:
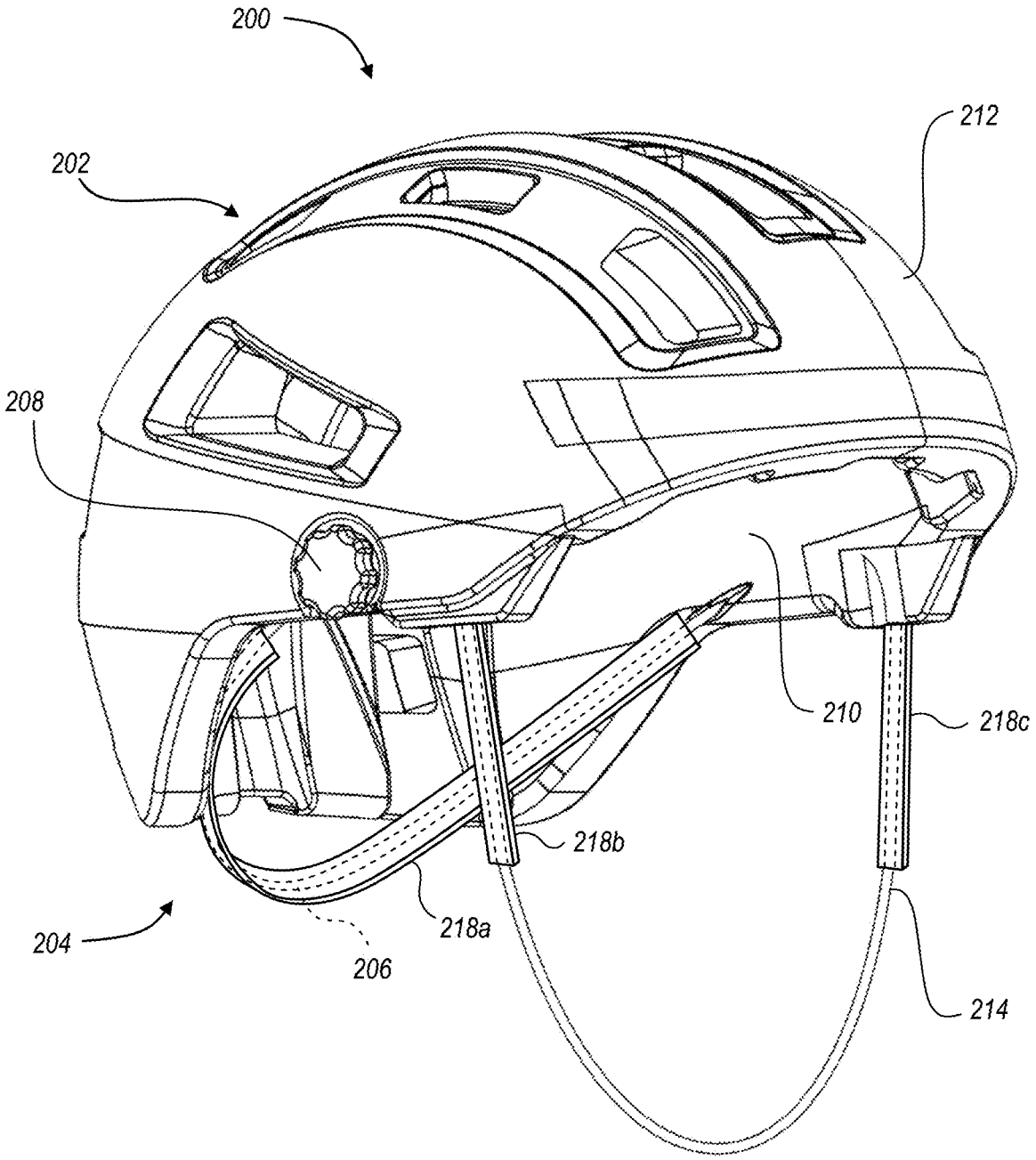
FIG. 2B schematically illustrates an embodiment of a protective helmet, adjustable fit assembly including a fit strap cable and optional chin strap cable, and position retention sheaths for the fit strap cable and optional chin strap cable.

FIG. 2B illustrates another embodiment of a helmet and adjustable fit assembly 800 having and an adjustable fit system 204, a fit strap cable 206, an actuator 208 operably connected to the fit strap cable 206 to adjust its length and tightness, and an optional chin strap cable 214. This embodiment further includes a position retention sheath 218*a* that encloses at least a portion of the fit strap cable 206, and optionally position retention sheaths 218*a*, 218*b* that partially enclose left and right sides of an optional chin strap cable 214. The position retention sheath 218*a* has a relative stiffness that helps maintain the fit strap cable 206 in a relatively fixed position relative to the helmet shell 202, and the optional position retention sheaths 218*b*, 218*c* have relative stiffnesses that help maintain the optional chin strap cable 214 in a relatively fixed position relative to the helmet shell 202. This assists the user to install and remove the helmet shell 202 from the user's head, such as by preventing the fit strap cable 206 and optional chin strap cable 214 from tangling or moving into positions that impede rather than facilitate installation and/or removal.

FIGS. 2C-2F schematically illustrate example position retention sheaths 218A-218D of different designs that provide different a different look and feel and possibly different levels of stiffness depending on the material used to make the position retention sheaths 218A-218D.

Figure 2C:
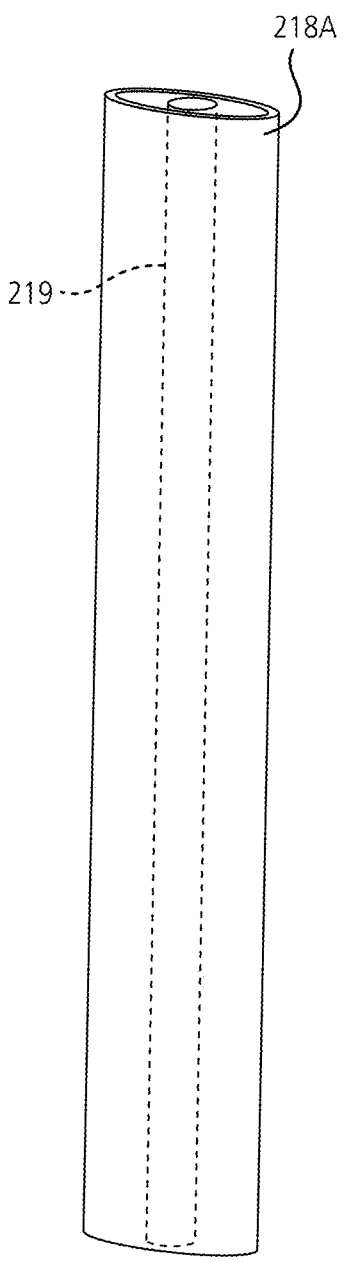
FIGS. 2C-2F schematically illustrate example position retention sheaths for maintaining a fit strap cable and optional chin strap cable in a desired position relative to a protective helmet.

FIG. 2C schematically illustrates a position retention sheath 218A having a generally oval cross section and a passageway 219 for receiving therein at least a portion of a fit strap cable 206 or optional chin strap cable 214. The volume between the outer wall forming the generally oval cross section and the passageway 219 can be solid polymer or include one or more gaps therebetween to reduce mass and/or increase flexibility.

Figure 2D:
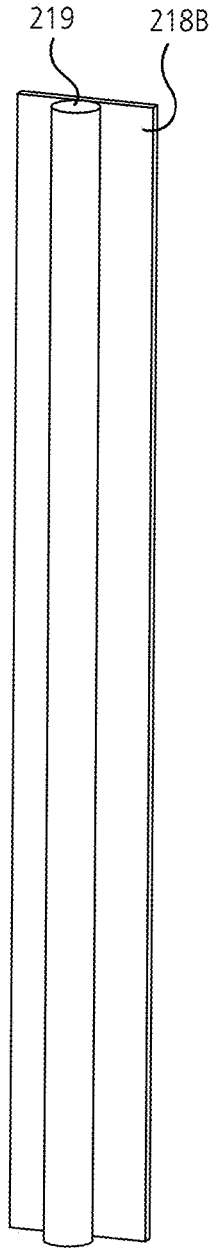

FIG. 2D schematically illustrates a position retention sheath 218B having a generally rectangular wall and a tubular portion that provides a passageway 219 for receiving therein at least a portion of a fit strap cable 206 or optional chin strap cable 214. The generally rectangular wall and a tubular portion can be constructed from a polymer material in order to provide a desired balance of stiffness and rigidity. The generally rectangular wall can be oriented toward to user's face to provide a smooth surface and shield the face from the protruding tubular portion.

Figure 2E:
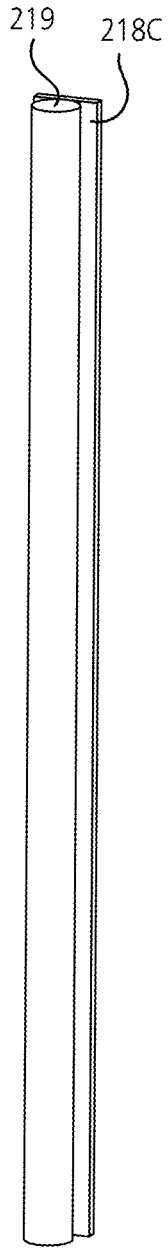

FIG. 2E schematically illustrates a position retention sheath 218C having a generally rectangular wall and a tubular portion that provides a passageway 219 for receiving therein at least a portion of a fit strap cable 206 or optional chin strap cable 214. The difference between this embodiment and the embodiment of FIG. 2D is the size of the generally rectangular wall, which is smaller in FIG. 2E in order to provide a desired balance of stiffness and rigidity depending on the polymer material being used.

Figure 2F:
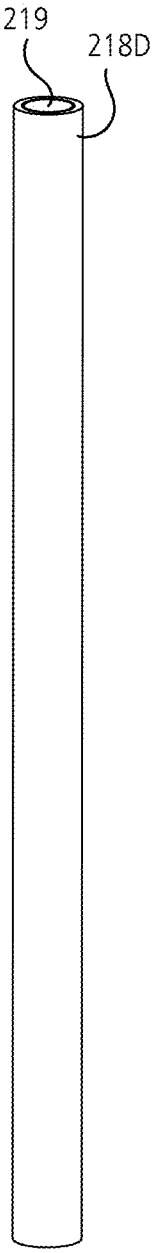

FIG. 2F schematically illustrates a position retention sheath 218D having a tubular structure that provides a passageway 219 for receiving therein at least a portion of a fit strap cable 206 or optional chin strap cable 214. The cross-sectional thickness of the tubular structure can be selected to provide a desired balance of stiffness and rigidity depending on the polymer material being used. The tubular structure can provide a generally smooth, curved outer surface that provides comfort to the user.

The position retention sheaths 218A-218D are advantageously formed from a polymer material that, when made into a sheath of desired cross section, will provide a desired level of stiffness in order to retain the fit strap cable 206 or optional chin strap cable 214 in a desired position relative to the helmet shell 202. While the term "stiffness" is used, it will be understood that the position retention sheaths 218A-218D need only be stiffer than the fit strap cable 206 or optional chin strap cable 214 in order to remain in a desired position relative to the helmet shell 202. Thus, the position retention sheaths 218A-218D can also be somewhat flexible and not be overly rigid in order to provide a balance between comfort to the user and the ability to retain the fit strap cable 206 or optional chin strap cable 214 in a desired position relative to the helmet shell 202. Thus, the polymer material can have a desired balance between rigidity and flexibility to ensure proper positioning of the fit strap cable 206 or optional chin strap cable 214 relative to the helmet shell 202 while, at the same time, providing comfort to the user.

Figure 3:
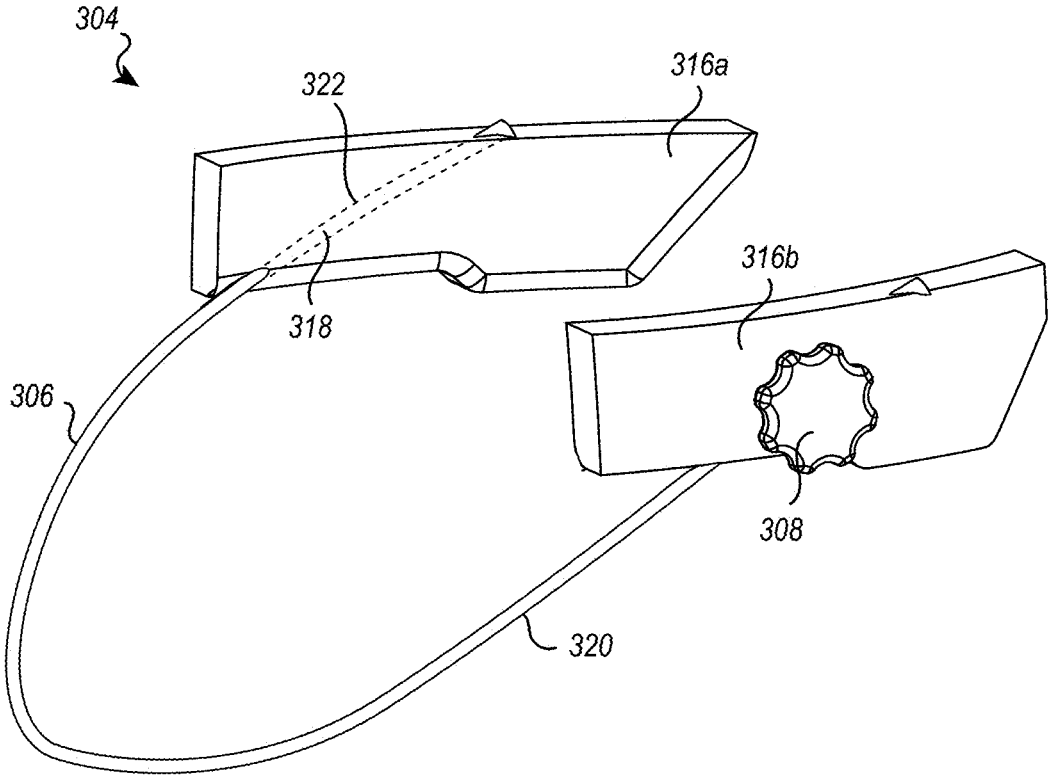
FIG. 3 schematically illustrates an embodiment of an adjustable fit system with an actuator configured for attachment to or at a side of a protective helmet near a wearer's ear.

FIG. 3 illustrates an embodiment of an adjustable fit system 304 comprising an actuator 308, a first housing 316*a* and a second housing 316*b*, and a fit strap 306 having a first end portion 318 and a second end portion 320, configured to be incorporated onto or into a helmet. The actuator 308 is operably connected to the fit strap 306 and configured to selectively shorten or lengthen the fit strap 306 in order to selectively tighten or loosen the adjustable fit system 304 relative to the wearer's head. A channel or duct 322 forming a groove, conduit, or space for receiving the first and second end portions 318, 320 of the fit strap 306 may be formed in the housings 3161, 316*b* in a manner similar to the helmet 200 described above. The adjustable fit system 304 may also comprise various mechanisms for shortening (tightening) the fit strap 306.

Figure 4:
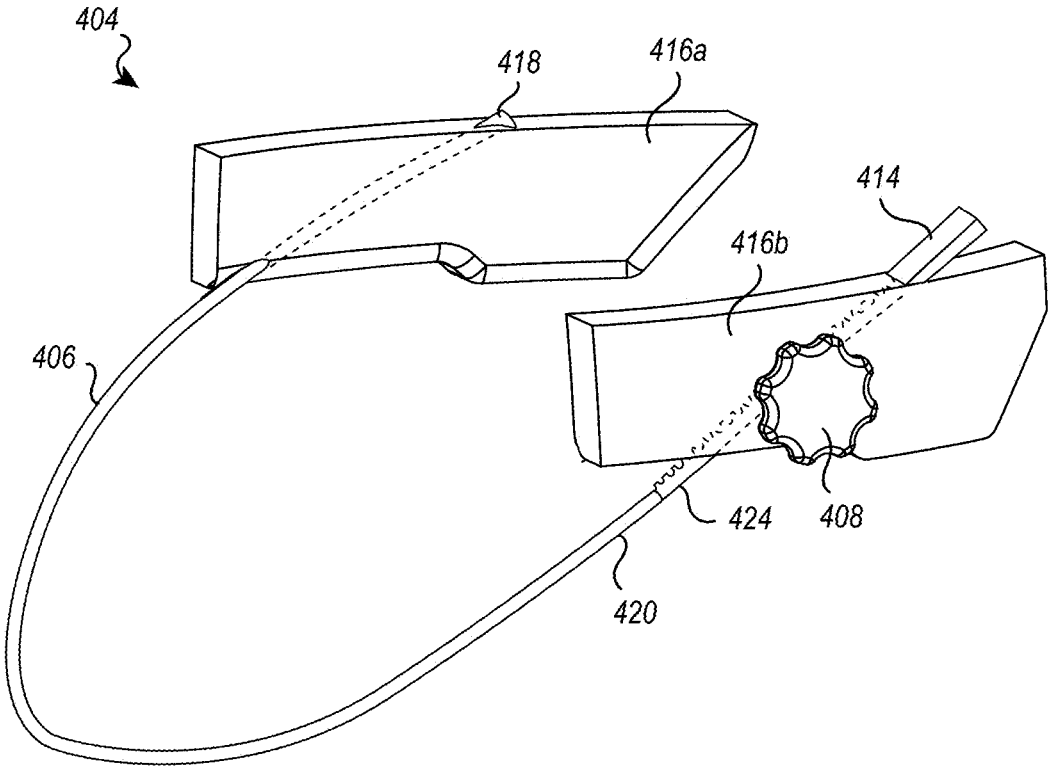
FIG. 4 schematically illustrates an exemplary embodiment of an adjustable fit system in which the actuator includes a pinion gear configured to engage a linear gear of the fit strap.

FIG. 4 illustrates an embodiment of an adjustable fit system 404 that may be assembled with a helmet, including a fit strap 406 having a first end portion 418 and a second end portion 420, first and second housings 416*a*, 416*b*, and an actuator 408 comprising a wheel and pinion gear (not shown). The actuator 408 is operably connected to the fit strap 406 and configured to selectively shorten or lengthen the fit strap 406 in order to selectively tighten or loosen the adjustable fit system 404 relative to the wearer's head. The first end portion 418 of the fit strap 406 may be positioned in or adjacent to a left side region or a right side region of a helmet or secured to the first housing 416*a* or second housing 416*b*. The second end portion 420 may be positioned in or adjacent a left side region or a right side region of a helmet. A linear gear 424 may be attached to or form a portion of the second end portion 420 of the fit strap 406, and which may be received by an anchor sleeve or duct 414 of the adjustable fit system 404. The actuator 408 may comprise a pinion gear (not shown) or other mechanism passing through the anchor sleeve or duct 414 and configured to engage the linear gear 424 of the fit strap 406, such that rotation of the actuator 408 in a first direction may shorten and tighten the fit strap 406 and rotation of the actuator 408 in a second direction opposite the first direction may lengthen and loosen the fit strap 406. In some embodiments, the second end portion 420 of the fit strap 406 may comprise one linear gear 424 configured to be engaged by a pinion gear of the actuator 408.

In some embodiments, the actuator 408 may comprise two or more positions for gross and fine adjustment in a manner similar to that described above. For example, in some embodiments the second end portion 420 of the fit strap 406 may comprise two or more linear gears 424, such as a first linear gear and a second linear gear (not shown), the first and second linear gears being disposed on the same portion of the fit strap 406. The actuator 408 may also comprise a first pinion gear configured to engage the first linear gear and a second pinion gear configured to engage the second linear gear. The first linear gear may comprise coarser teeth being separated by a first distance (i.e., a gap between the teeth of the linear gear configured to receive the teeth of the corresponding pinion gear) and the second linear gear may comprise finer teeth being separated by a second distance, the first distance being greater than the second distance. The adjustable fit system 404 may then be configured such that the first pinion gear of the actuator 408 engages the first linear gear of the fit strap 406 when in the first position, and the second pinion gear of the actuator 408 engages the second linear gear of the fit strap 406 when in the second position, the actuator 408 providing gross adjustment of the fit strap 406 when in the first position and fine adjustment of the fit strap 406 when in the second position.

Figure 5:
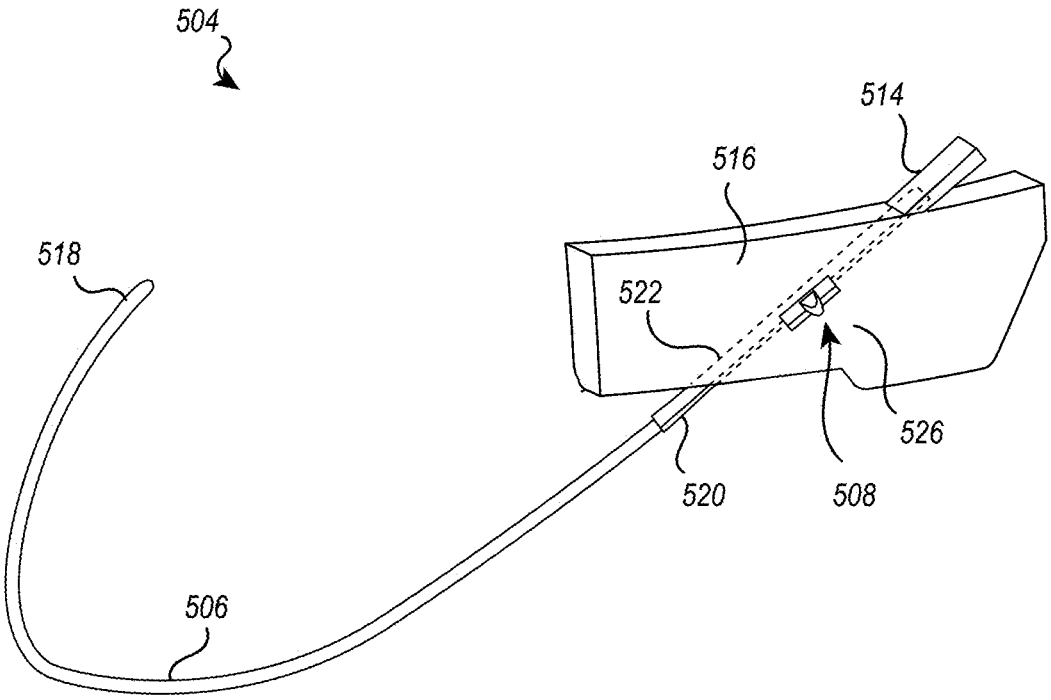
FIG. 5 schematically illustrates an exemplary embodiment of an adjustable fit system having an actuator comprising a slider.

FIG. 5 illustrates an exemplary embodiment of an adjustable fit system 504, comprising a housing 516, a fit strap 506 having a first end portion 518 and a second end portion 520, a channel 522 disposed within the housing 516 configured to receive the second end portion 520, and an actuator 508. The actuator 508 is operably connected to the fit strap 506 and configured to selectively shorten or lengthen the fit strap 506 in order to selectively tighten or loosen the adjustable fit system 504 relative to the wearer's head. The actuator 508 may be attached to or form a part of the second end portion 520 of the fit strap 506. The actuator 508 in this embodiment comprises a slider 526 such that the fit strap 506 can be tightened or loosened by manipulating the position of the slider 526, which may be achieved by moving the slider 526 in a first direction or a second direction. The slider 526 and/or second end of the fit strap 506 may be configured to frictionally or otherwise engage the anchor sleeve 514 such that the anchor sleeve 514 functions to hold the fit strap 506 in the position set by the wearer. In some embodiments, at least a portion of the slider 526 may be embedded in the housing 516 or helmet. In such embodiments, at least a portion of the slider 526 will be accessible to the wearer to adjust the tightness of the fit strap 506.

Figure 6:
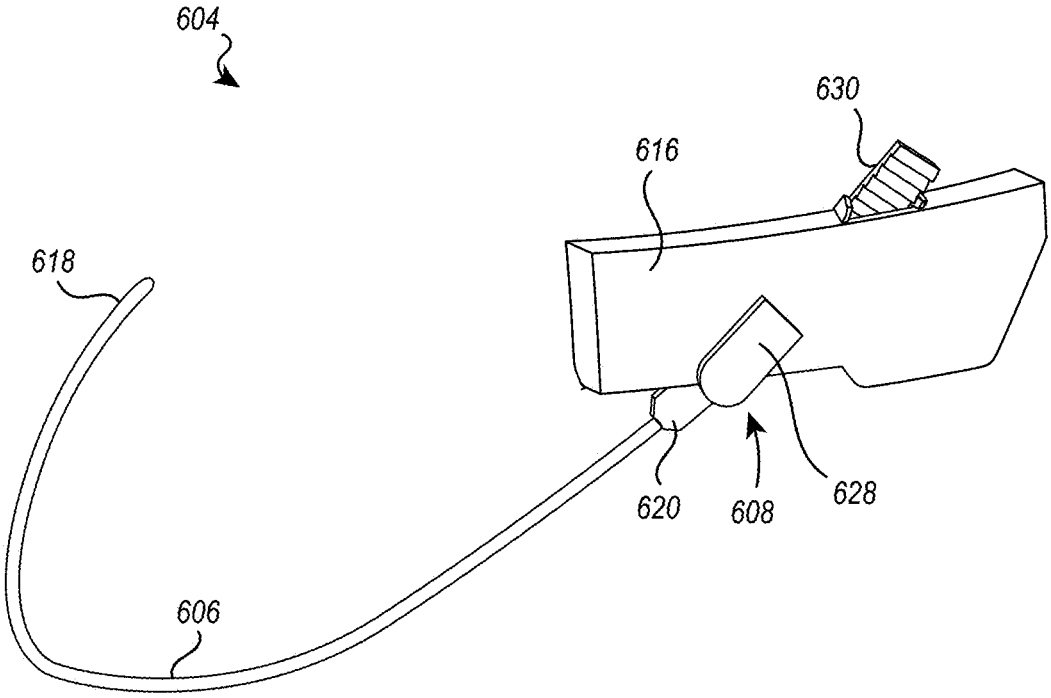
FIG. 6 schematically illustrates an exemplary embodiment of an adjustable fit system comprising a buckle type actuator.

FIG. 6 illustrates yet another embodiment of an adjustable fit system 604 comprising a fit strap 606 having a first end portion 618 and a second end portion 620, a housing 616, and an actuator 608. The actuator 608 is operably connected to the fit strap 606 and configured to selectively shorten or lengthen the fit strap 606 in order to selectively tighten or loosen the adjustable fit system 604 relative to the wearer's head. In this embodiment, the actuator 608 comprises a buckle-type actuator including a buckle 628 configured to engage a buckle catch 630 that is attached to or forms a part of the second end portion 620 of the fit strap 606, similar to the micro buckles of a ski boot. The buckle 628 engages the buckle catch 630 to either tighten or loosen the fit strap 606. In some embodiments, the fit strap 606 may be tightened by pushing the second end portion 620 of the fit strap 606 past the actuator 608 to attain the desired tightness, the buckle 628 engaging the buckle catch 630 to prevent the loosening of the fit strap 606. In some embodiments, the fit strap 606 may be loosened by pressing the buckle 628 and pulling on a portion of the fit strap 606 between the first and second end portions 618, 620. In some embodiments, the buckle 628 is at least partially embedded in the housing 616 or helmet. In such embodiments, at least a portion of the buckle 628 will be accessible to the wearer to adjust the tightness of the fit strap 606.

Figure 7:
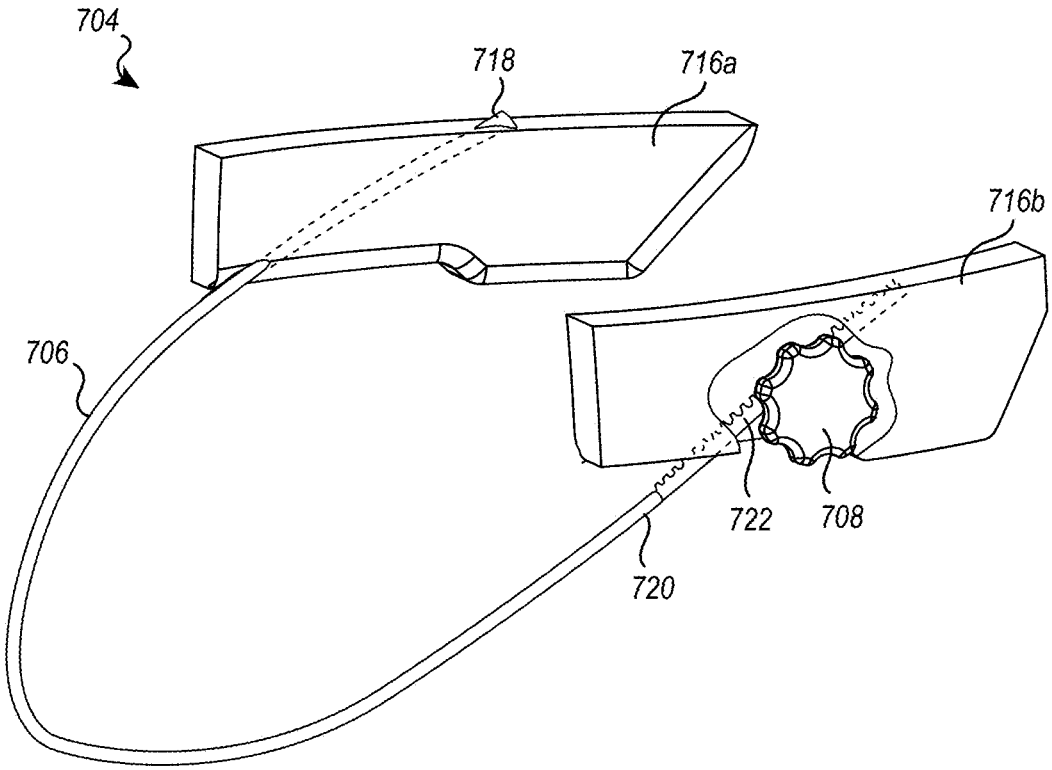
FIG. 7 schematically illustrates an exemplary embodiment of an adjustable fit system wherein the actuator is embedded within a housing.

FIG. 7 illustrates an exemplary embodiment of an adjustable fit system 704 having a fit strap 706, first and second housings 716*a*, 716*b*, and an actuator 708 configured to engage a second end portion 720 of the fit strap 706. The actuator 708 is operably connected to the fit strap 706 and configured to selectively shorten or lengthen the fit strap 706 in order to selectively tighten or loosen the adjustable fit system 704 relative to the wearer's head. As illustrated, the wheel of the actuator 708 may be at least partially embedded in the housing 716*b*. In other embodiments, the wheel of the actuator 708 may be at least partially embedded in the helmet, such as sandwiched between inner and outer shell components 110, 112 (See FIGS. 1A-1B). If the actuator 708 is embedded in the housing 716*b* or helmet, a portion of the actuator 708 can be readily accessible by the wearer.

Figure 8:
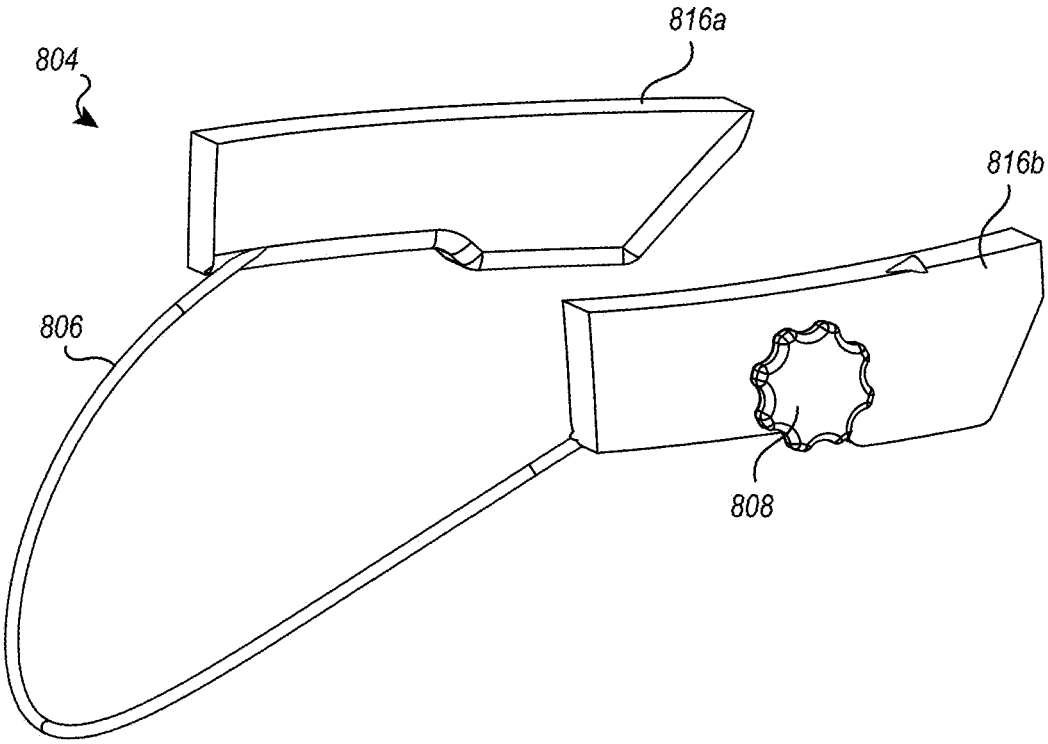
FIG. 8 schematically illustrates another embodiment of an adjustable fit system with a wheel type actuator.

FIG. 8 illustrates another embodiment of an adjustable fit system 804 of the present disclosure that includes first and second housings 816*a*, 816*b*. An actuator 808 is operably connected to the a strap 806 and configured to selectively shorten or lengthen the fit strap 806 in order to selectively tighten or loosen the adjustable fit system 804 relative to the wearer's head. The fit strap 806 may be configured to be inserted into negative space within the housing 816*a* and or housing 816*b*. The housings 816*a*, 816*b* are configured to attach to various iterations of different types of protective helmets. In this embodiment, the actuator 808 is side accessible, easy to reach and manipulate, thereby enabling easy adjustment of the fit strap 806 by the wearer while engaging in an activity. The housings 816*a*, 816*b* may be made of a variety of materials, including but not limited to plastics and metals. The housings 816*a*, 816*b* may be of monolithic construction with negative space to receive an anchor sleeve or duct. In other embodiments, the housings 816*a*, 816*b* may be constructed with multiple parts which would allow for removal of internal components, such as anchor sleeve or ducts, for replacement or repair. In any embodiment, the housings 816*a*, 816*b* may be configured to be externally attached to or internally embedded within a protective helmet.

Figure 9A:
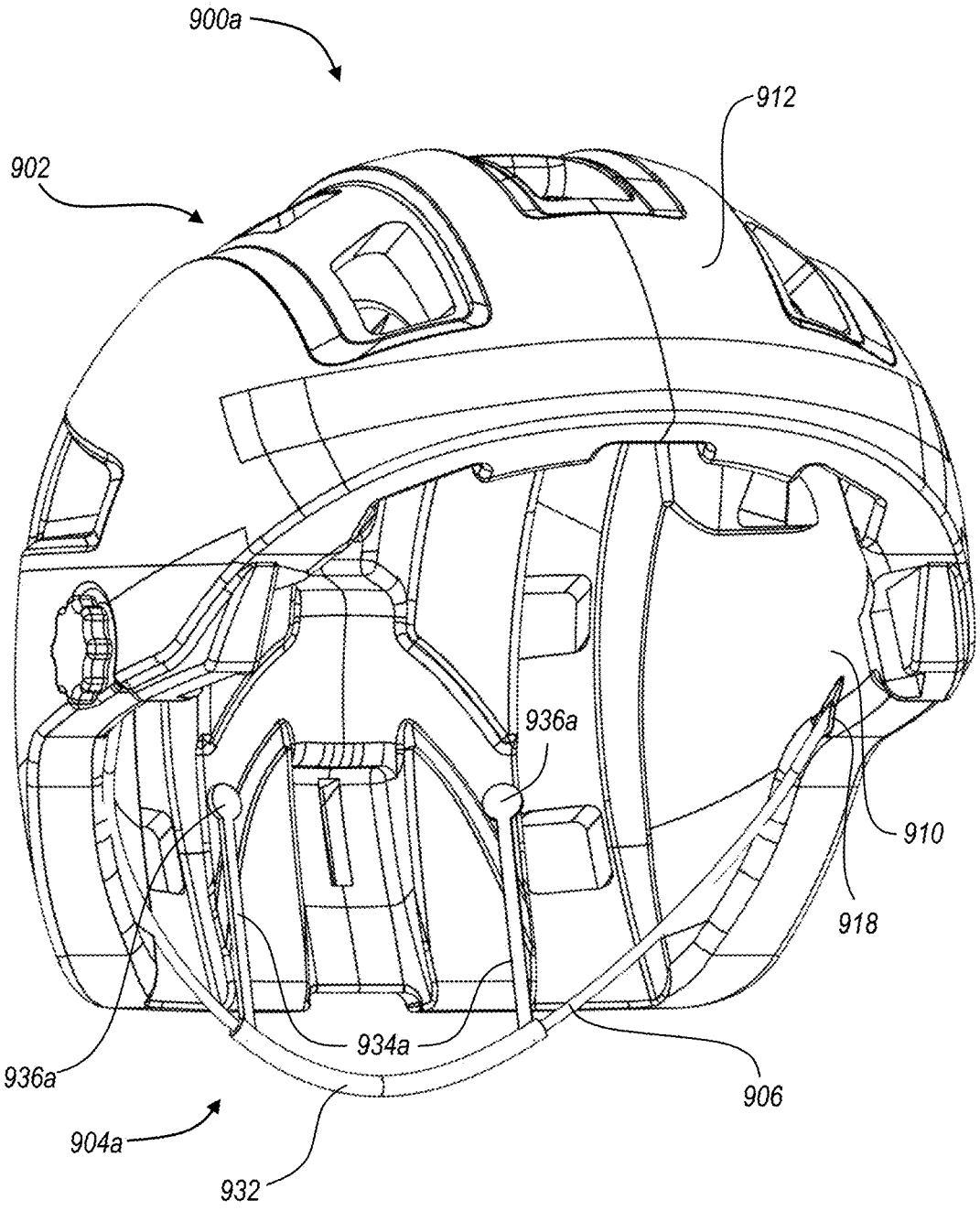
FIG. 9A schematically illustrates an embodiment of a protective helmet incorporating an adjustable fit system.
Figure 9B:
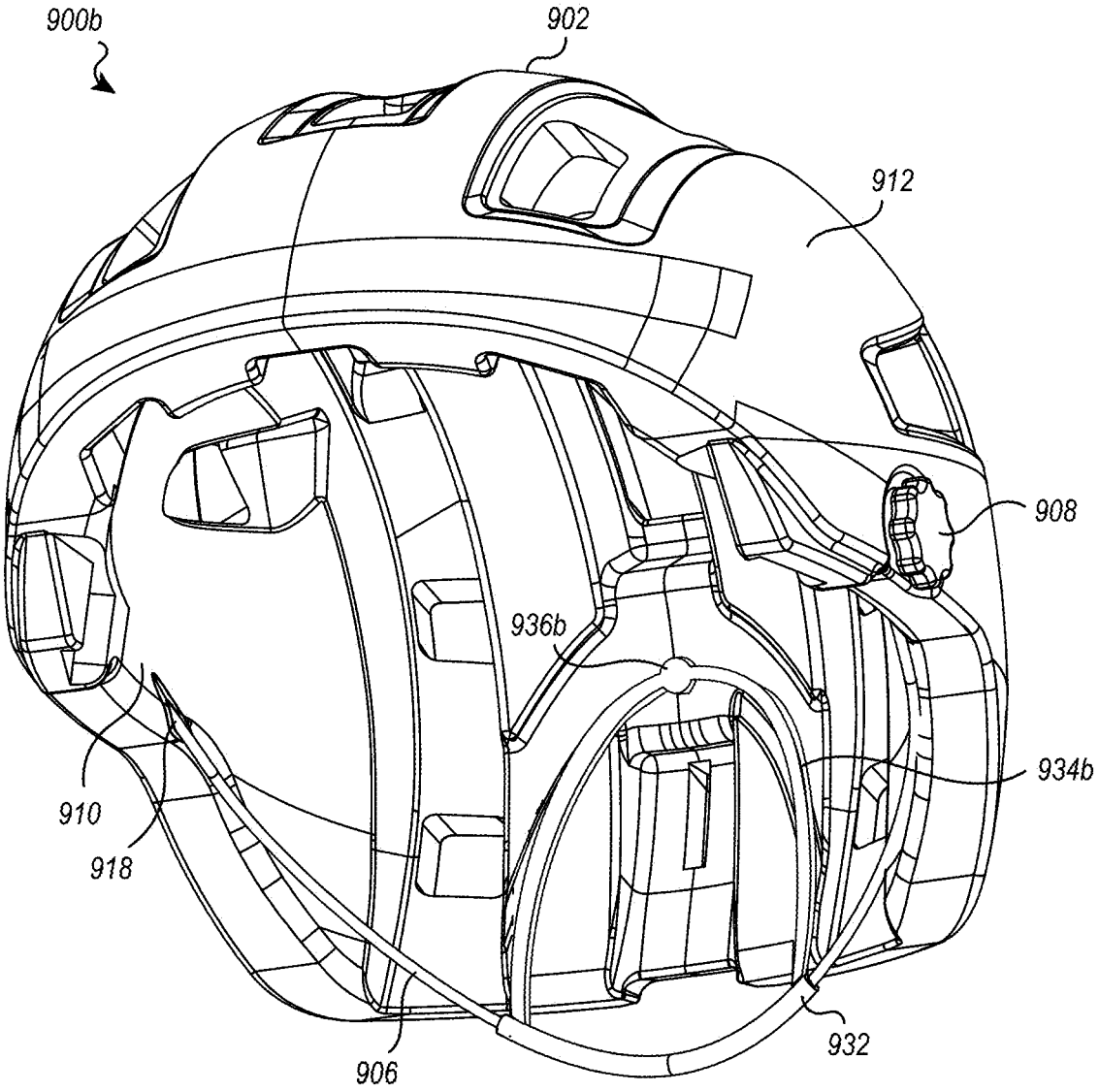
FIG. 9B schematically illustrates another embodiment of a protective helmet incorporating an adjustable fit system.

FIGS. 9A and 9B illustrate exemplary embodiments of helmet and adjustable fit assemblies 900*a* and 900*b*, having a helmet shell 902 and an adjustable fit system 904*a* or 904*b*. An elongated fit strap 906 has two ends, at least one of which is received by a duct 918 within the helmet shell 902. An actuator 908 is operably connected to the fit strap 906 and configured to selectively shorten or lengthen the fit strap 906 in order to selectively tighten or loosen the fit strap 906 relative to the wearer's head. The helmet and adjustable fit assemblies 900*a*, 900*b* may comprise a rear anchor sleeve or duct 932 configured to prevent the fit strap 906 from traveling over the head of the wearer (e.g., when tightening the fit strap 906). The rear anchor sleeve or duct 932 may be constructed from a polymer, including plastic or fabric materials. The rear anchor sleeve 932 may also comprise padding or other soft materials for contacting the head of the wearer. The rear anchor sleeve 932 may be secured to the helmet shell 902 by one or more anchor arms 934*a*, 934*b*. The anchor arms 934*a*, 934*b* may formed from a relatively rigid material (e.g., a rigid polymer) having sufficient flexibility to allow the rear anchor sleeve 932 to move up against the head of a wearer but being sufficiently rigid to prevent the rear anchor sleeve 932 from traveling over the head of a wearer.

FIG. 9A illustrates a helmet and adjustable fit assembly 900*a* with a rear anchor sleeve 932 having two anchor arms 934*a* fastened to the helmet shell 902 at two distinct anchor points 936*a*. FIG. 9B illustrates an alternative embodiment of a helmet and adjustable fit assembly 900*b* having a rear anchor sleeve 932, wherein both anchor arms 934*b* of the rear anchor sleeve 932 are connected at a single anchor point 936*b*. The anchor arms 934*a*, 934*b* may be attached to the helmet shell 902 at the anchor points 936*a*, 936*b* by friction clipping, adhesive, or other means. For example, the anchor arms 934*a*, 934*b* may be attached to the inner component 910 of the shell 902, the outer component 912 of the shell 902, or both. In some embodiments, the position of the anchor points 936*a*, 936*b* may be adjusted by the wearer so as to provide an improved and more comfortable fit.

Additional Terms & Definitions

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

The invention claimed is:

1. A helmet and adjustable fit assembly, comprising:

a helmet configured to at least partially cover a wearer's head, wherein the helmet includes:

a helmet shell comprising:

a front and a back; and a left side region having a left ear area and a right side region having a right ear area;

an adjustable fit system including:

a fit strap or fit strap cable configured to attach to the helmet shell, engage only a back portion of the wearer's head, and having two opposing ends, a first end configured to be received within the helmet shell at or behind the left ear area and attach to the helmet shell inside the left side region, and a second end configured to be received within the helmet shell at or behind the right ear area and attach to the helmet shell inside the right side region; and an actuator configured to attach to either the left side region or the right side region of the helmet shell and be operably connected to the fit strap or fit strap cable so that actuating the actuator selectively increases or decreases a length of the fit strap or fit strap cable in order to selectively loosen or tighten the fit strap or fit strap cable, respectively, relative to the wearer's head, wherein the actuator extends through the left side region or the right side region of the helmet shell so as to be accessible by a user at an exterior of the left side region or the right side region of the helmet shell, wherein selective tightening of the fit strap or fit strap cable urges the wearer's head against a front inner surface of the helmet shell, and wherein the actuator is coupled to either the first end or the second end of the fit strap or fit strap cable, and an opposing end of the fit strap or fit strap cable is anchored at an opposing left side region or right side region of the helmet shell.

2. The helmet and adjustable fit assembly of claim 1, wherein the fit strap or fit strap cable comprises a fit strap cable, and the helmet and adjustable fit assembly further comprises a retention sheath that at least partially encloses the fit strap cable, wherein the retention sheath is stiffer than the fit strap cable in order to maintain the fit strap cable in a desired position relative to the helmet shell.

3. The helmet and adjustable fit assembly of claim 1, wherein the actuator comprises a slider, detent, spring pump, pawl and ratchet, wheel, pinion gear, or other means for selectively increasing or decreasing the length of the fit strap or fit strap cable.

4. The helmet and adjustable fit assembly of claim 1, wherein the helmet shell includes a channel, groove, or space configured to house or receive a portion of the fit strap or fit strap cable when shortened or lengthened by the actuator.

5. The helmet and adjustable fit assembly of claim 1, further comprising a linear gear connected to or forming part of the fit strap or fit strap cable at or near one of the two opposing ends and being positioned in or adjacent to the left side region or the right side region of the helmet shell.

6. The helmet and adjustable fit assembly of claim 5, wherein the actuator comprises a wheel and pinion gear configured to engage the linear gear such that selectively rotating the actuator in a first direction shortens the fit strap or fit strap cable and rotating the actuator in an opposite direction lengthens the fit strap or fit strap cable.

7. The helmet and adjustable fit assembly of claim 1, further comprising an anchor sleeve disposed in one of the left side region or the right side region of the helmet shell and configured to receive an end of the fit strap or fit strap cable opposite an end of the fit strap or fit strap cable operably connected to the actuator.

8. The helmet and adjustable fit assembly of claim 7, further comprising a second anchor sleeve configured to receive the end of the fit strap or fit strap cable operably connected to the actuator, wherein the actuator passes through the second anchor sleeve to maintain communication with the fit strap or fit strap cable.

9. The helmet and adjustable fit assembly of claim 1, wherein the fit strap or fit strap cable comprises webbing and padding on at least a portion of the fit strap or fit strap cable.

10. The helmet and adjustable fit assembly of claim 1, further comprising a chin strap or chin strap cable configured to secure the helmet to a wearer's head during use.

11. A helmet and adjustable fit assembly, comprising:

a helmet configured to at least partially cover a wearer's head, wherein the helmet includes:

a helmet shell comprising:

a front and a back; and a left side region having a left ear area and a right side region having a right ear area; and an adjustable fit system including:

a fit strap or fit strap cable configured to attach to the helmet shell, engage a wearer's head, and having two opposing ends, a first end configured to be received inside the helmet shell at or behind the left ear area and attach to the helmet shell inside the left side region and a second end configured to be received inside the helmet shell at or behind the right ear area and attach to the helmet shell inside the right side region;

an actuator configured to attach to either the left side region or the right side region of the helmet shell and be operably connected to one of the first or second ends of the fit strap or fit strap cable so that actuating the actuator selectively increases or decreases a length of the fit strap or fit strap cable in order to selectively loosen or tighten the fit strap or fit strap cable, respectively, relative to the wearer's head; and an anchor sleeve disposed inside one of the left side region or the right side region of the helmet shell and configured to receive another one of the first or second ends of the fit strap or fit strap cable, wherein selective tightening of the fit strap or fit strap cable urges the wearer's head against an inner surface of the helmet shell.

12. The helmet and adjustable fit assembly of claim 11, wherein the fit strap or fit strap cable comprises a fit strap cable, and wherein the fit strap cable comprises either a single-stranded cable or a dual-stranded cable, wherein when the fit strap cable comprises a dual-stranded cable, the helmet further comprises a length-equalizing wheel disposed on or in the helmet shell.

13. The helmet and adjustable fit assembly of claim 12, further comprising a retention sheath that at least partially enclose the fit strap cable, wherein the retention sheath is stiffer than the fit strap cable in order to maintain the fit strap cable in a desired position relative to the helmet shell.

14. The helmet and adjustable fit assembly of claim 11, wherein the actuator comprises a slider, detent, spring pump, pawl and ratchet, wheel, pinion gear, or other means for selectively increasing or decreasing the length of the fit strap or fit strap cable.

15. The helmet and adjustable fit assembly of claim 11, further comprising:

a first anchor sleeve or duct configured to receive a first end of the fit strap or fit strap cable and permit the first end of the fit strap or fit strap cable to slide freely through a length of the first anchor sleeve or duct; and a second anchor sleeve or duct configured to receive a second end of the fit strap or fit strap cable and permit the second end of the fit strap or fit strap cable to slide freely through a length of the second anchor sleeve or duct, wherein one opposing end of the fit strap or fit strap cable is configured to be anchored within the first anchor sleeve or duct.

16. The helmet and adjustable fit assembly of claim 15, wherein at least one of the first or second anchor sleeves or ducts comprises a one-way push-to-connect slot configured to receive and retain one of the opposing ends of the fit strap or fit strap cable.

17. The helmet and adjustable fit assembly of claim 15, further comprising a first housing defining the first anchor sleeve or duct and a second housing defining the second anchor sleeve or duct, wherein each housing is configured to be attached to or embedded within the helmet shell.

18. The helmet and adjustable fit assembly of claim 15, further comprising a rear anchor sleeve or duct configured to attach to the helmet shell, receive a portion of the fit strap or fit strap cable, and prevent the fit strap or fit strap cable from traveling over a wearer's head.

19. A helmet and adjustable fit assembly, comprising:

a helmet configured to at least partially cover a wearer's head, wherein the helmet includes:

a helmet shell comprising:

a front and a back; and a left side region having a left ear area and a right side region having a right ear area;

an adjustable fit system including:

a dual-stranded fit strap cable configured to attach to the helmet shell, engage a wearer's head, and interact with a length-equalizing wheel, the dual-stranded fit strap cable having two ends configured to attach to a same side of either the left side region or the right side region, and wherein the two ends are received inside of the helmet shell at a or behind either the right ear area or the left ear area;

an actuator configured to attach to either the left side region or the right side region of the helmet shell and be operably connected to one of the two ends of the dual-stranded fit strap cable, with the other end being fixed to the helmet shell at the same left or side region as the actuator, so that actuating the actuator selectively increases or decreases a length of the dual-stranded fit strap cable in order to selectively loosen or tighten the dual-stranded fit strap cable, respectively, relative to the wearer's head; and the length-equalizing wheel disposed inside the helmet shell on a side opposite the actuator and the two ends of the dual-stranded fit strap cable and interacting with the dual-stranded fit strap cable, wherein selective tightening of the first strap cable urges the wearer's head into contact with an inner surface of the helmet shell.

* * * * *